United States Patent [19]

Matsumoto et al.

[11] 4,389,113

[45] Jun. 21, 1983

[54] IMPROVED DEVELOPING DEVICE FOR TWO-COLOR ELECTROPHOTOGRAPHIC COPYING APPARATUS

[75] Inventors: Fuyuhiko Matsumoto, Wako; Kunihiko Ikeda, Kodaira; Shuichi Tsushima, Tokyo, all of Japan

[73] Assignee: Ricoh Company, Ltd., Tokyo, Japan

[21] Appl. No.: 261,782

[22] Filed: May 8, 1981

[30] Foreign Application Priority Data

May 15, 1980 [JP] Japan ..... 55-116426

[51] Int. Cl.[3] ..... G03G 15/09

[52] U.S. Cl. ..... 355/3 DD; 118/658

[58] Field of Search ..... 355/3 DD, 4; 118/657, 118/658, 661; 430/122

[56] References Cited

U.S. PATENT DOCUMENTS

| | | | |
|---|---|---|---|
| 3,905,332 | 9/1975 | Sawada et al. | 118/661 |
| 3,960,445 | 6/1976 | Drawe | 355/4 |
| 4,018,187 | 4/1977 | Abbott et al. | 118/658 |
| 4,136,637 | 1/1979 | Snelling | 118/658 |

*Primary Examiner*—R. L. Moses

*Attorney, Agent, or Firm*—Oblon, Fisher, Spivak, McClelland & Maier

[57] ABSTRACT

An improved two-color electrophotographic copying apparatus comprising a non-magnetic sleeve for supplying magnetic toner to latent electrostatic images formed on a photoconductor, for the development of said images, for use in one or both of the development section for the two colors, whereby, by means of the so-called counter electrode effect, two-color copies can be obtained in which the so-called edge effect has been completely or substantially eliminated. In one category of embodiments, a series of ridges and grooves are formed on the outer peripheral surface of the non-magnetic sleeve. The peaks of those ridges serve to decrease the effective distance between the non-magnetic sleeve and the surface of the photoconductor, which decrease in distance is advantageous in enhancing the counter electrode effect. At the same time, the grooves provide means for the carrying of sufficient toner past a doctor in the apparatus, whereas, heretofore, getting sufficient toner past said doctor was the difficulty in decreasing the aforesaid distance from the non-magnetic sleeve to the photoconductor. In another category of embodiments, the ridges and grooves are formed spirally or in some similar orientation around the surface of the magnetic sleeve, with the effect that toner carried by the sleeve and deposited on the photoconductor is also moved in a lateral direction (axially along the surface of the sleeve), which movement serves to dislodge toner lightly held in unwanted fringe portions of the image due to incomplete, though enhanced, operation of the counter electrode effect, whereby the final traces of the edge effect are eliminated.

13 Claims, 19 Drawing Figures

IMPROVED DEVELOPING DEVICE FOR TWO-COLOR ELECTROPHOTOGRAPHIC COPYING APPARATUS

BACKGROUND OF THE INVENTION

The present invention relates to a two-color electrophotographic copying apparatus for making two-color copies from two-color originals and more particularly to a two-color electrophotographic copying apparatus capable of eliminating the so-called edge effect.

The principle of two-color electrophotography is that two latent electrostatic images with opposite polarities to each other, corresponding to each color of a two-color original, are formed on a latent electrostatic image bearing member and the two latent electrostatic images are developed by two color-toners charged to opposite polarities to each other, whereby two-color copy images are obtained.

Two types of latent electrostatic image bearing members are known for two-color electrophotography. One is of a dielectric type and the other is of a photoconductive type.

The dielectric type latent electrostatic image bearing member comprises an electrostatic recording base sheet or electrically conductive support member and a dielectric layer formed on the base sheet or on the support member. On the dielectric type latent electrostatic image bearing member latent electrostatic images with positive and negative polarities are formed by a multi-stylus electrode.

For instance, with respect to two original images A and B with different colors, two image signals a and b, respectively corresponding to the two original images A and B, are applied to the multi-stylus electrode. In accordance with the image signals applied, the surface of the latent electrostatic image bearing member is electrically charged. For instance, by the image signal a, the surface is positively charged, and by the image signal b, the surface is negatively charged, whereby positively and negatively charged patterns corresponding to the two original images A and B are formed on the latent electrostatic image bearing member. The thus formed positively and negatively charged patterns on the latent electrostatic image bearing member are developed by two types of toner particles with different colors, charged to opposite polarities.

Thus, visible images with different colors corresponding to the original images A and B can be obtained on the surface of the latent electrostatic image bearing member. When the latent electrostatic image bearing member is of a sheet type, the developed visible images can be fixed to the sheet type latent electrostatic image bearing member. When it is not of a sheet type, the developed images can be transferred to a recording sheet and fixed thereto.

As to photoconductive type latent electrostatic image bearing members, there are variety of types, and the latent image formation processes are slightly different depending upon the construction of the latent electrostatic image bearing members.

A two-color copying process by use of a representative photoconductive type latent electrostatic image bearing member, comprising an electrically conductive support member and a photoconductive layer formed thereon, will now be explained. Hereinafter, the photoconductive type latent electrostatic image bearing member is simply referred to as the photoconductor.

Referring to FIG. 1, there is shown diagrammatically the two-color process by use of the above-described type photoconductor. In the figure, reference numeral 1 indicates the photoconductor which comprises an electrically conductive base 10, a first photoconductive layer 11 formed on the electrically conductive base 10, and a second photoconductive layer 12 formed on the first photoconductive layer 11.

The photoconductor 1 is prepared so as to have properties such that when white light is projected to the photoconductor 1, both the photoconductive layers 11 and 12 are made electrically conductive, while when red light is projected thereto, only the photoconductive layer 12 is made electrically conductive.

As shown in FIG. 1, in Step (1), a first charging is conducted by applying positive charges of the photoconductor 1 by a corona charger, while illuminating the photoconductor 1 with red light. Since the photoconductive layer 12 is made electrically conductive by red light, the positive charges applied to the photoconductor 1 are distributed throughout the interface between the first photoconductive layer 11 and the second photoconductive layer 12. At the same time, negative charges, whose absolute value is equal to that of the applied positive charges, are induced and distributed throughout the interface between the electrically conductive base 10 and the first photoconductive layer 11, thus forming an electric double layer with the first photoconductive layer 11 sandwiched therebetween. With respect to the first photoconductive layer 11, this state is referred to as the electrically charged state.

In Step (2), a second charging is conducted by applying negative charges to the surface of the photoconductor 1 in the dark by a corona charger, while maintaining the absolute value of the negative charges smaller than the absolute value of the positive charges in the first charging. The applied negative charges are distributed throughout the surface of the second photoconductive layer 12, so that the surface potential of the photoconductor is reversed to a negative polarity. At the same time, the counterpart positive charges are induced in the interface between the electrically conductive base 10 and the first photoconductive layer 11. The induced counterpart positive charges are neutralized with part of the negative charges that have been induced in the interface between the electrically conductive base 10 and the first photoconductive layer 11 during the first charging. As a result, the following two electric double layers are formed in the photoconductor 1.

One electric double layer is formed by the positive charges (i) in the interface between the first photoconductive layer 11 and the second photoconductive layer 12 and the negative charges (ii) in the interface between the first photoconductive layer 11 and the electrically conductive layer 10. The other double layer is formed by the above-mentioned positive charges (i) and the negative charges (iii) on the surface of the second photoconductive layer 12.

In these electric double layers, their dipole moments are directed in opposite directions. With respect to the photoconductive layers 11 and 12, the above-mentioned state is referred to the oppositely charged state.

In order to produce the above-mentioned state with respect to the photoconductive layers 11 and 12, it is necessary that the interface between the first photoconductive layer 11 and the second photoconductive layer 12 have a predetermined charged retention capability. In order to secure such charge retention capability, an intermediate layer can be placed between the first photoconductive layer 11 and the second photoconductive layer 12.

In Step (3), the photoconductor 1 is exposed to the optical images of an original O, while maintaining the first and second photoconductive layers 11 and 12 in the above-mentioned oppositely charged state. It is supposed that the original O has a black image area BL and a red image area R with a white background W. When the photoconductor 1 is exposed to the optical images of the original O, an area PW in the photoconductor 1, corresponding to the white background of the original O, is exposed to white light, and an area PR in the photoconductor 1, corresponding to the red image area R, is exposed to red light. With respect to an area PBL in the photoconductor 1, corresponding to the black image area BL, no light is projected thereto.

Since the area PW corresponding to the white background is exposed to white light, the photoconductive layers 11 and 12 in the area PW of the photoconductor 1 are made electrically conductive and all the charges are conducted away from the area PW, resulting in the surface potential in the area PW of the photoconductor 1 being nearly zero.

In the area PR of the photoconductor 1 corresponding to the red image area R, the photoconductive layer 12 is made electrically conductive by the red light reflected from the red image area R and the negative charges are dissipated from the surface of the second photoconductive layer 12. As a result, the polarity of the surface potential of the photoconductor 1 in the area PR is reversed to a positive polarity by the positive charges remaining in the interface between the first photoconductive layer 11 and the second photoconductive layer 12.

The area PBL of the photoconductor 1 corresponding to the black image area BL retains its negative surface potential since the photoconductor 1 in that area is not exposed to any light as aforementioned.

Thus, on the surface of the photoconductor 1, there are formed three different areas with respect to surface potential, that is, a negative latent electrostatic image area PBL corresponding to the black image area BL of the original O, a positive latent electrostatic image area PR corresponding to the red image area R of the original O, and a nearly zero-potential area PW corresponding to the white background W of the original O.

In Step (4), red toner TR which has been charged to a negative polarity is applied to the photoconductor 1. The red toner TR is electrostatically attracted only to the positive potential area PR of the photoconductor 1, so that the red image area R of the original O is reproduced there. Thereafter, black toner TBL which has been charged to a positive polarity is supplied to the photoconductor 1. The black toner TBL is electrostatically attracted only to the negative potential area PBL of the photoconductor 1, so that the black image area PBL of the original O is reproduced there, while no toner is deposited on the background area PW.

Referring to FIG. 2, there is diagrammatically shown the changes in surface potential of the photoconductor 1 during the two-color image formation process described above.

As shown in FIG. 2, in Step (1), the photoconductor 1 is charged to a positive polarity by the first charging conducted, while illuminating the photoconductor 1 with red light.

In Step (2), the surface potential of the photoconductor 1 is reversed to a negative polarity by the second charging conducted in the dark.

In Step (3), the photoconductor 1 is exposed to the optical images of the original O and the surface potential of the area PR in the photoconductor 1, corresponding to the red image area R, is reversed to a positive polarity as shown by Curve PR. The surface potential of the area PW in the photoconductor 1, corresponding to the white background W, is made nearly zero as shown by Curve PW, while the surface potential of the area PBL in the photoconductor 1, corresponding to the black image area BL, remains at a negative polarity as shown by Curve PBL.

Referring to FIG. 3, there is diagrammatically shown an example of a copying machine for conducting the above-mentioned two-color copying process.

In the figure, reference numeral 1 indicates a drum-shaped photoconductor. The photoconductor 1 is rotated in the direction of the arrow. The photoconductor 1 is uniformly charged to a positive polarity by a first charger 2, while illuminated uniformly by red light which is obtained by filtering the light from a lamp 21 through a red filter 22.

The positively charged photoconductor 1 is then uniformly charged to a negative polarity by a second charger 3 in the dark. Thus, the first and second photoconductive layers 11 and 12 of the photoconductor 1 are in the oppositely charged state, which has been previously mentioned in explanation of Step (2).

The optical images of an original including two different colored images are projected upon the thus charged photoconductor 1. By the mechanism explained previously in connection with Step (3), a latent electrostatic image with a positive polarity and a latent electrostatic image with a negative polarity are formed on the surface of the photoconductor 1. The thus formed latent electrostatic images with opposite polarities are successively developed by a first development apparatus 4 containing red toner and a second development apparatus 5 containing black toner. The two-colored developed images were subjected to positive charging by a pre-charger 6, so that the developed images are made entirely positive in polarity and are then electrostatically transferred to a recording sheet S by an image transfer charger 7. The developed images are fixed to the recording sheet S by an image fixing apparatus (not shown) and the recording sheet S is then discharged from the copying machine.

After image transfer, the remaining charges on the photoconductor 1 are quenched by a quenching charger 8 and the residual toner on the photoconductor 1 is removed therefrom by a cleaning appratus 9.

The development apparatuses 4 and 5 are of a magnetic brush type, employing a two-component type developer comprising toner and powder-like magnetic carrier.

The development apparatuses 4 and 5 are basically the same in construction, with slight differences between them, for instance, in the rotating direction of their non-magnetic sleeve and positioning of their developer scraper. Therefore, taking the development apparatus 5 as an example, its construction will now be explained by referring to FIG. 6.

In FIG. 6, the development apparatus 5 comprises a developer container 51, a magnetic roller 52 and a scraper 53. The magnetic roller 52 comprises a non-magnetic sleeve 54 and a roller-shaped or block-shaped magnet 55 disposed within the sleeve 54. The magnet 55 is disposed stationarily, while the non-magnetic sleeve 54 is rotatable in the direction of the arrow. When the sleeve 54 is rotated in the direction of the arrow, developer D is attracted to the sleeve 54 through the magnetic force of the magnet 55 and held on the peripheral surface of the sleeve 54. The quantity of the developer D supplied to a development section between the photoconductor 1 and the sleeve 54 is regulated by a doctor 51A. As a result, a magnetic brush is formed in the development section between the sleeve 54 and the surface of the photoconductor 1, developing the latent electrostatic images formed on the photoconductor 1. The developer D which has not been used for development is separated from the peripheral surface of the sleeve 54 by the scraper 53 and is then returned to the developer container 51.

As mentioned previously, the first development apparatus 4 contains red toner, while the second development apparatus 5 contains black toner. The red image is first developed and thereafter the black image is developed. The reason for adopting this sequence is as follows: In general, in two-color development, when the first and second developments are performed successively by two separate development apparatuses, part of the first toner employed in the first development is apt to contaminate the second toner in the second development apparatus, changing the color of the second toner to some extent. When red toner is placed in the first development apparatus 4 and black toner is placed in the second development apparatus 5 as mentioned above, if a small amount of the red toner happens to be mixed with the black toner, the color of the black toner will be, as a practical matter, hardly, if at all, changed by the admixed red toner. In contrast to this, in the case where the black toner is placed in the first development apparatus 4 and red toner is placed in the second developer 5, the color of the red toner may be considerably changed by a small amount of admixed black toner, and if that takes place, the red image will not be reproduced in pure red any longer.

As mentioned above, in the two-color electrophotography using either a dielectric type latent electrostatic image bearing member or a photoconductive type latent electrostatic image bearing member, positive and negative latent electrostatic images are formed on the latent image bearing member and those positive and negative latent electrostatic images are developed by two types of toner with different colors and with opposite polarities. This two-color electrophotography has a shortcoming called "edge effect" that will now be explained.

For instance, with respect to a black copy image, its edge effect is illustrated in FIG. 4. In the figure, reference symbol BL1 represents a black copy image. Around the black copy image BL1, there is a white background portion W1 which is fringed with a thin red toner portion R1. This phenomenon is called the edge effect. How the edge effect occurs is generally explained as follows:

When a drastic change in surface potential exists near the edge of a latent electrostatic image formed on the photoconductor, an electric field directed in the direction opposite to the direction of the electric field present in the inner portion of the latent electrostatic image is formed near the edge of the latent electrostatic image.

For instance, the distribution of the intensity of the electric field in the black copy image and thereabouts taken on line L—L in FIG. 4 is shown in FIG. 5.

Referring to FIG. 5, when the minimum intensity of electric field for initiating deposition of black toner TBL is at line $L_1$, the black toner TBL is deposited in the portion indicated by reference symbol BL11, since in the portion BL11 the intensity of the electric field with a negative polarity is above the line L1. As a result, the black copy image BL1 as shown in FIG. 4 is formed in that portion. Further, it is supposed that the minimum intensity of the electric field for initiating deposition of red toner TR is at line L2. In this case, when development is conducted using red toner TR, red toner TR is deposited in a portion R11 where the intensity of the electric field with a positive polarity is greater than the intensity of the electric field at line L2, in terms of the positive polarity direction. As a result, the red toner fringe R1 is formed around the black copy image BL1.

In the area W11 where the intensity of electric field ranges between L1 and L2, no toner is deposited, so that the white background area W1 as shown in FIG. 4 is formed.

Likewise, when a red image is developed and a black image is then developed using black toner, a black toner fringe is formed around the red toner image.

In other words, when red image development using the red toner TR is first performed and black image development using black toner TBL is then performed, red toner images and red fringes are formed in the first development and black toner images and black fringes are formed in the second development.

Conventionally, several methods for obviating the above-mentioned edge effect have been proposed.

For example, in one method, a development bias voltage is applied to the non-magnetic sleeve of the magnetic roller for applying developer to the photoconductor during development (refer to FIG. 6). In another conventional method, toners with different quantities of electric charges are employed. In a further conventional method, the surface potential of the background area in the photoconductor is not made zero, but it is slightly charged to a positive or negative polarity. These methods, however, are not satisfactory for eliminating the edge effect to the extent that they can be employed for practical use.

A still further conventional method is to prevent the edge effect by utilizing the so-called counter electrode effect of the non-magnetic sleeve of the magnetic roller. The counter electrode effect of the sleeve will now be explained by referring to FIGS. 7(*a*) and 7(*b*).

When a latent electrostatic image with a positive polarity is formed on the surface of the photoconductor 1 and directed towards the sleeve 54 with a comparatively great gap $g_1$ between the surface of the photoconductor 1 and the surface of the sleeve 54, most of the electric line of force from the latent electrostatic image is directed towards the surface of the sleeve 54, but part of the electric line of force generated from a fringe portion of the latent electrostatic image is directed back to the photoconductor 1 as shown in FIG. 7(*a*), inducing negative charges around the latent electrostatic image and causing the aforementioned edge effect.

In contrast, when the gap $g_1$ between the photoconductor 1 and the sleeve 54 is decreased as shown in FIG. 7(*b*), the counter electrode effect of the sleeve 54 is increased and such electric line of force as returns to the photoconductor 1 is significantly decreased in number and the edge effect is hardly caused. This is the aforementioned conventional method of preventing the edge effect by utilizing the counter electrode effect of the sleeve.

In that conventional method, however, when the gap $g_1$ is decreased as shown in FIG. 7(*a*), the gap $g_2$ between the sleeve 54 and the doctor 51A (refer to FIG. 6) has also to be decreased. Otherwise, too much developer is supplied to a development section indicated by Hb between the photoconductor 1 and the sleeve 54. As a result, the development section Hb will be clogged by the developer supplied.

In order to reduce the edge effect to the extent required for practical use, it is necessary that the gap $g_1$ and $g_2$ be approximately 1 mm. On the other hand, for supplying the developer to the development section Hb for a sufficient image density for practical use, it is required that the gap $g_1$ and $g_2$ be in the range from 2.5 mm to 3.5 mm. In other words, when the gaps $g_1$ and $g_2$ are about 1 mm, the edge effect can be eliminated, but a sufficient image density cannot be obtained.

A method of preventing the edge effect has been developed by the inventors of the present invention, which method is particularly directed to improvement on the shortcoming of the above-mentioned conventional method.

In that method, carrier particles with a volume resistivity smaller than that of the conventional carrier are employed in the developer for the second development. Hereinafter, the developer employed in the first development is referred to as the first developer, and the carrier particles of the first developer, the first carrier particles; and the developer in the second development is referred to as the second developer, and the carrier particles of the second developer, the second carrier particles.

By use of such carrier particles with a small volume resistivity in the second developer, the edge effect can be prevented, while maintaining the gaps $g_1$ and $g_2$ (refer to FIG. 6 and FIGS. 7(*a*) and 7(*b*)) in the normal range of 2.5 mm to 3.5 mm.

Specifically, in order to prevent the edge effect, it is preferable that the volume resistivity of the carrier particles contained in the second developer be in the range of $10^5\Omega\cdot$cm to $10^8\Omega\cdot$cm.

For instance, in the case of a dielectric type latent electrostatic image bearing member, latent electrostatic images with positive and negative polarities exist on the surface of the latent image bearing member. During the first development, the carrier particles of the first developer are brought into contact with both the positive and negative latent electrostatic images. If the volume resistivity of the carrier particles in the first developer is extremely low, for instance, lower than $10^5\Omega\cdot$cm, the second latent electrostatic image to be developed by the second developer is disturbed during the first development by the first carrier particles by the leakage of the electric charges of the second latent electrostatic image through the first carrier particles. Therefore, it is required that the volume resistivity of the first carrier particles in the first developer be in the normal range of $10^{10}\Omega$cm to $10^{11}\Omega$cm.

Furthermore, in the case of a photoconductive type latent electrostatic image bearing member as shown in FIG. 1, the black image area PBL in the photoconductor 1 corresponding to the black image area BL of the original O is formed by the negative charges on the surface of the photconductor 1, while the red image area PR in the photoconductor 1 corresponding to the red image R of the original O is formed by the positive charges present in the interface between the first photoconductive layer 11 and the second photoconductive layer 12.

When the red image area PR is developed by the first developer containing the first carrier particles with low volume resistivity, the black image area PBL of the photoconductor 1 is disturbed by the first carrier particles since the negative charges of the black image area PBL are leaked through the first carrier particles.

In contrast, when the black image area PBL is developes by the first developer containing the first carrier particles with low volume resistivity, the above-mentioned problem does not occur, since the positive charges in the red image area PR are present in the interface between the first photoconductive layer 11 and the second photoconductive layer 12, and the first carrier particles are not brought into direct contact with those positive charges.

As mentioned above, with respect to the use of carrier particles with low volume resistivity, there are the following three cases: (1) the case where latent electrostatic images with positive and negative polarities, formed on a dielectric type latent electrostatic image bearing member, are developed by the first and second developers; (2) the case where a photoconductive type latent electrostatic image bearing member is employed and a first latent electrostatic image is formed by positive charges present in the interface between the first photoconductive layer 11 and the second photoconductive layer 12 and a second latent electrostatic image is formed by negative charges on the surface of the second photoconductive layer 12, and the first latent electrostatic image is developed by the first developer; and (3) the case where a photoconductor as described in (2) is employed and the second latent electrostatic image is developed by the first developer.

Of the above-mentioned three cases, only in the last case (3) can carrier particles with such low volume resistivity be employed in the first developer. In the other two cases, it is required that the volume resistivity of the first carrier particles in the first developer be in the range of $10^{10}\Omega\cdot$cm to $10^{11}\Omega\cdot$cm, while the volume resistivity of the second carrier particles are in the range of $10^5\Omega\cdot$cm to $10^8\Omega\cdot$cm, as mentioned above.

The effect of the above-mentioned method of preventing the edge effect, using in the second developer the carrier particles with a volume resistivity smaller than that of the carrier particles in the first developer, has been experimentally confirmed by the inventors of the present application as follows:

On the peripheral surface of an aluminum drum, a first photoconductive layer comprising a selenium-tellurium alloy, the concentration of tellurium being 10 weight percent of the total of selenium and tellurium, was formed with a thickness of 40 $\mu$m. On the first photoconductive layer, an intermediate layer comprising a phenolic material and a copper phthalocyanine complex was formed with a thickness of 1 $\mu$m. On the intermediate layer, there was formed a second photoconductive layer with a thickness of 20 $\mu$m comprising an eutectic mixture of selenium and tellurium, so that a photoconductive latent electrostatic image bearing member was formed.

The thus formed photoconductive latent electrostatic image bearing member was incorporated as the photoconductor 1 in the electrophotographic copying machine as shown in FIG. 1. In accordance with the same procedure as mentioned previously, the first charging and the second charging were successively conducted, followed by exposure of the photoconductor 1 to the optical images of an original having a red image area and a black image area with a white background. The surface potential of a red image area PR in the photoconductor 1, corresponding to the red image area of the original, was +420 volts; the surface potential of a black image area PBL in the photoconductor 1, corresponding to the black image area of the original, −610 volts; and the surface potential of a background area PW in the photoconductor 1, corresponding to the white background, −30 volts.

The thus formed red image area PR was developed by magnetic brush development, using a first developer comprising red toner with an electric charge quantity ranging from −13 μC/g to −15 μC/g and carrier particles with a volume resistivity of $10^{11}\Omega$·cm, under application of a development bias voltage ranging from +70 volts to +120 volts to the non-magnetic sleeve of a magnetic roller in the first development apparatus 4 (refer to FIG. 3).

The black image area PBL was then developed with a second developer comprising black toner with an electric charge quantity ranging from 6 μC/g to 8 μC/g and carrier particles with a volume resistivity of $10^{7}\Omega$·cm, under application of a development bias voltage ranging from −100 volts to −150 volts to the non-magnetic sleeve of a magnetic roller in the second development apparatus 5 (refer to FIG. 3).

The thus formed red and black toner images were entirely charged to a positive polarity by the pre-charger 6 (refer to FIG. 3) and were then transferred to a recording sheet S. No edge effect was observed in the copy image, and the copy quality was high.

In this development, it is considered that the edge effect was successfully prevented mainly for the following reasons:

In the first development, the comparatively large quantity of charges of the red toner and the development bias voltage applied to the non-magnetic sleeve effectively worked for preventing the edge effect. In the second development, the volume resistivity of the carrier particles of the second developer was low, so that the counter electrode effect worked. In addition, the development bias voltage applied to the non-magnetic sleeve served to eliminate the edge effect.

For comparison, a copying test was conducted using the same electrophotographic apparatus. In this comparative test, the first developer was a developer comprising red toner with an electric charge quantity of −10 μC/g and carrier particles with a volume resistivity of $10^{11}\Omega$·cm, and the second developer was a developer comprising black toner with an electric charge quantity of +10 μC/g and carrier particles with a volume resistivity of $10^{11}\Omega$·cm, which was the same as that of the carrier particles of the first developer. The result was that, around both the red images and the black images, the edge effect was conspicuously observed.

The above-mentioned method is particularly directed to improvement on the shortcomings of the conventional methods of eliminating the edge effect based on the utilization of the counter electrode effect of the non-magnetic sleeve of the magnetic roller. As has been explained in detail, in the above-mentioned method, by use of carrier particles with a comparatively small volume resistivity in the second development, the counter electrode effect of the non-magnetic sleeve of the magnetic roller is advantageously enhanced with respect to the photoconductor which is disposed in proximity with the non-magnetic sleeve. In this sense, this method is undoubtedly useful.

The inventors considered that the above-mentioned method can be improved further from a mechanical point of view, because the counter electrode effect is unquestionably a phenomenon between the non-magnetic sleeve and the surface of the latent electrostatic image bearing member.

SUMMARY OF THE INVENTION

It is therefore an object of the present invention to provide a two-color electrophotographic copying apparatus for making two-color copies from two-color originals, in particular, capable of eliminating the edge effect from copy images, utilizing the counter electrode effect of an improved non-magnetic sleeve of a magnetic roller for performing magnetic brush development.

According to the present invention, in order to attain the above-mentioned object, multiple ridges and grooves are formed on the surface of the non-magnetic sleeve. When developer is carried by that non-magnetic sleeve to the development section between the non-magnetic sleeve and the peripheral surface of a latent electrostatic image bearing photoconductor, the effective gap between the non-magnetic sleeve and the photoconductor, in terms of the counter electrode effect, can be decreased, while supplying a sufficient amount of the developer to the development section for developing the latent electrostatic image on the photoconductor with high image density. This is because the gap between the non-magnetic sleeve and the photoconductor, in terms of the counter electrode effect, is decreased by the ridges directed to the peripheral surface of the photoconductor, while a sufficient amount of the developer is held on the non-magnetic sleeve, since the developer is not only attracted to the ridges, but is also held in the grooves on the surface of the non-magnetic sleeve during development. As a result, the edge effect can advantageously eliminated.

Various shapes and configurations of the ridges and grooves are proposed in the present invention.

In one embodiment, the ridges and grooves are formed in the direction parallel with the axis of the non-magnetic sleeve and the cross section of each ridge in the direction normal to the axial direction is rectangular. In another embodiment, that cross section is trapezoidal.

In a further embodiment, the ridges and grooves are formed in the shape of parallel rings on the surface of the non-magnetic sleeve.

In a still further embodiment, the ridges and grooves are formed in a spiral manner on the surface of the non-magnetic sleeve.

DETAILED DESCRIPTION OF THE PREFERRED EMBODIMENTS

As mentioned previously, in order to eliminate the edge effect in two-color electrophotography, enhancing the counter electrode effect of the non-magnetic sleeve is very effective. One of the simplest ways to enhance the counter electrode effect of the non-magnetic sleeve is to decrease the gap between the non-magnetic sleeve and the latent electrostatic image bearing photoconductor. However, in order to obtain copy images with high image density, a sufficient amount of the developer has to be supplied to that gap and, therefore, the gap has to be of a certain minimum width. Thus, the method of decreasing the edge effect by simply decreasing the gap between the non-magnetic sleeve and the photoconductor has a practical limit.

From this point of view, in the present invention, multiple ridges and grooves are formed on the surface of the non-magnetic sleeve, at least in the second development apparatus.

Figure 1:
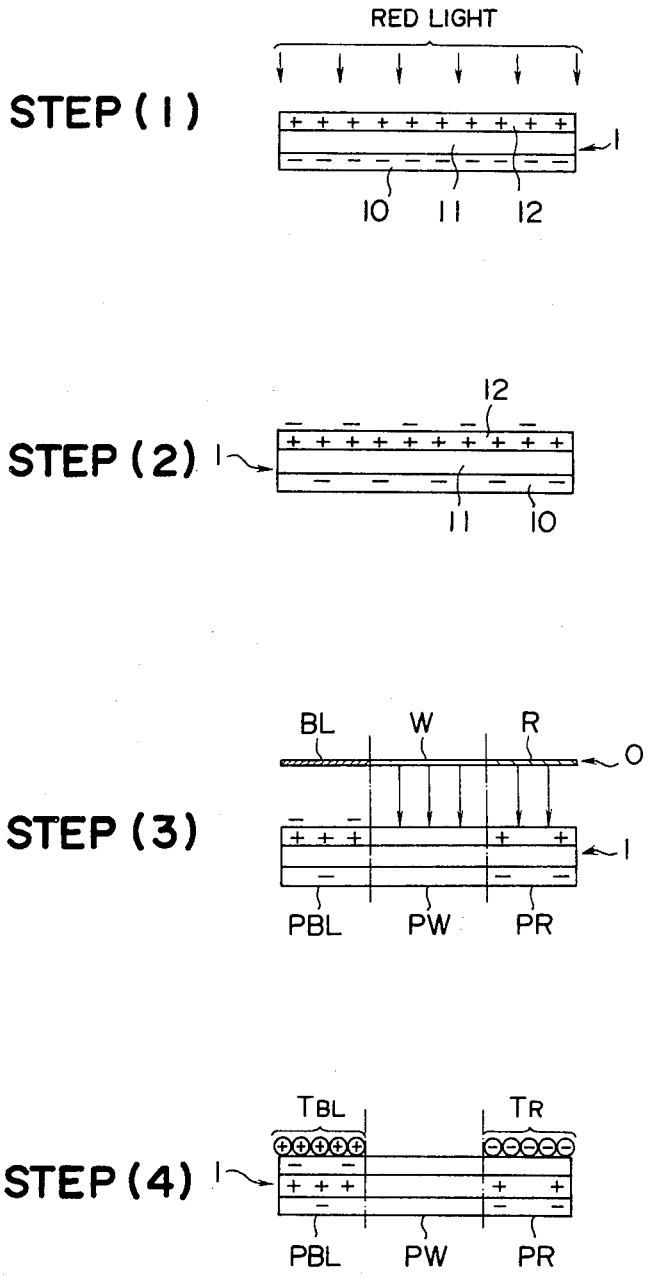
FIG. 1 is a diagram showing the principle of a two-color electrophotographic copying process.
Figure 2:
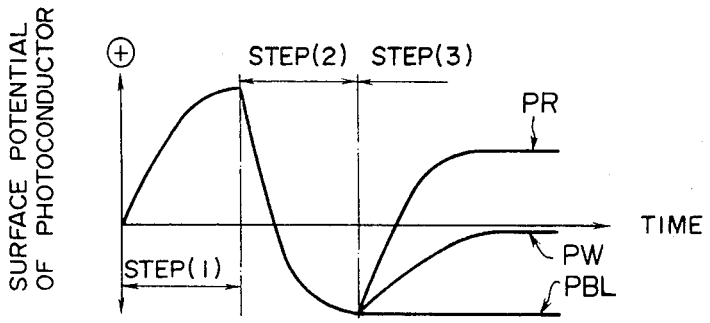
FIG. 2 is a diagram showing the changes in surface potential of an electrophotographic photoconductor employed in the two-color electrophotographic copying process shown in FIG. 1.
Figure 3:
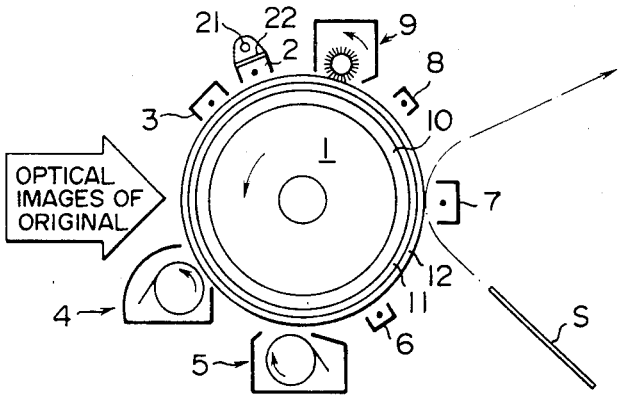
FIG. 3 is a diagrammatical view of a two-color electrophotographic copying apparatus.
Figure 8:
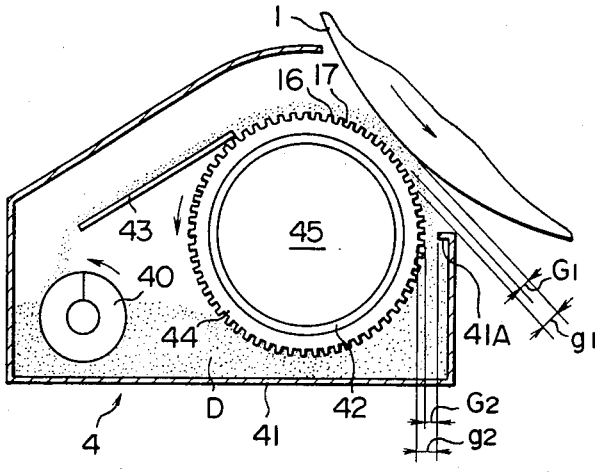
FIG. 8 is a diagrammatical view of a development apparatus for use in the present invention.

Referring to FIG. 8, there is diagrammatically shown a development apparatus for use in the present invention. In the development apparatus, a magnetic roller 42 including a non-magnetic sleeve 44 with ridges and grooves formed in the axial direction of the non-magnetic sleeve on the peripheral surface of the non-magnetic sleeve, is employed. The development apparatus shown in FIG. 8 is the first development apparatus 4 in FIG. 3. The developer D comprising red toner and carrier particles, held in a developer container 41, is mixed by a stirrer 40, so that the toner and the carrier particles are triboelectrically charged and attracted onto the non-magnetic sleeve 44 through the magnetic force of a magnet 45 disposed inside the non-magnetic sleeve 44. With the rotation of the non-magnetic sleeve 44, while the magnet 45 is stopped, the developer D is carried upwards. The amount of the developer on the non-magnetic sleeve 44 is regulated by a doctor 41A and is then brought into contact with latent electrostatic images formed on the surface of the photoconductor 1, developing the latent electrostatic images. The developer D remaining on the non-magnetic sleeve 44, which has not been used for development, is scraped therefrom by a scraper 43 and is then returned to the developer container 41.

As aforementioned, on the peripheral surface of the non-magnetic sleeve 44, multiple ridges and grooves are formed in the axial direction of the non-magnetic sleeve 44.

Figure 9:
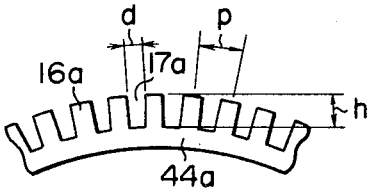
FIG. 9 is a sectional view of part of a non-magnetic sleeve for use in the present invention.

Referring to FIG. 9, a cross sectional view of each ridge in the direction normal to the axial direction of a non-magnetic sleeve 44*a* is rectangular and the height of the ridges, h, is in the range from 0.5 mm to 2.5 mm (the ridges being uniform for each sleeve). The pitch of the ridges, p, which can be defined, for example, as the distance from the center of one ridge to the center of the adjacent ridge, is in the range from 1 mm to 20 mm, and the width of each groove between the ridges is in the range not less than 1/10 the pitch of the ridges, p, preferably in the range from 1/10 to $\frac{1}{2}$ the pitch of the ridges, p. When the width of the groove is less than 1/10 the pitch of the ridges, the developer transportation performance of the non-magnetic sleeve decreases.

Figure 10:
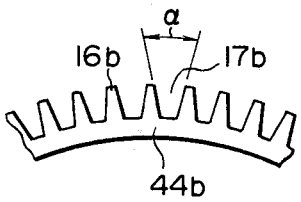
FIG. 10 is a sectional view of part of another non-magnetic sleeve for use in the present invention.

The cross section of the ridges is not limited to a rectangle, but it can be a trapezoid as in a non-magnetic sleeve 44*b* shown in FIG. 10. In this case, the angle $\alpha$ which is formed by the two side walls of each groove is preferably approximately 30°.

Referring back to FIG. 8, in a conventional two-color electrophotographic copying machine, it is supposed that the optimum gap g1 between the conventional smooth non-magnetic sleeve and the photoconductor is 4.1 mm and the optimum gap g2 between the non-magnetic sleeve and the doctor 41A is 2.8 mm. In this case, when the conventional non-magnetic sleeve is replaced with a non-magnetic sleeve with ridges with a height of 1.5 mm, h, on the surface thereof, the effective gap G1 between the sleeve and the photoconductor 1 is g1-h=4.1 mm-1.5 mm=2.6 mm. The apparent gap G2 between the sleeve and the doctor 41A is g2-h=2.8 mm-1.5 mm=1.3 mm, but the effective gap remains 2.8 mm to the bottom of the grooves.

Figure 11:
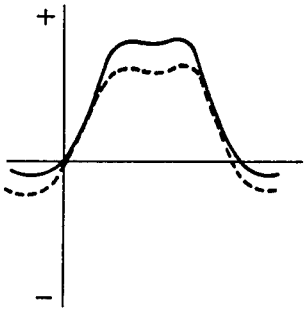
FIGS. 11 and 12 are diagrams in explanation of the counter electrode effect obtained by the present invention.
Figure 12:
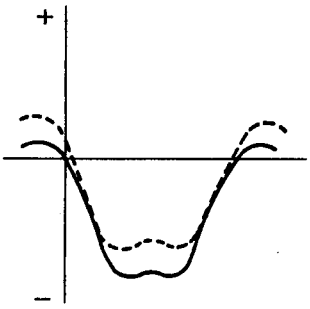

When the effective gap G1 between the non-magnetic sleeve and the photoconductor 1 is thus decreased, the counter electrode effect of the sleeve can be increased significantly. As a result, the surface potential for initiating deposition of red toner on the latent electrostatic image area in the photoconductor 1, corresponding to a red image of the original, is raised from the broken line position to the solid line position as shown in FIG. 11, so that a red copy image with high image density can be obtained. With respect to the surface potential of a black image area, the surface potential for initiating deposition of black toner is increased towards a negative polarity as shown by the solid line in FIG. 12 and, therefore, the formation of a red fringe around the black copy image and of a black fringe around the red copy image can be prevented.

Figure 13:
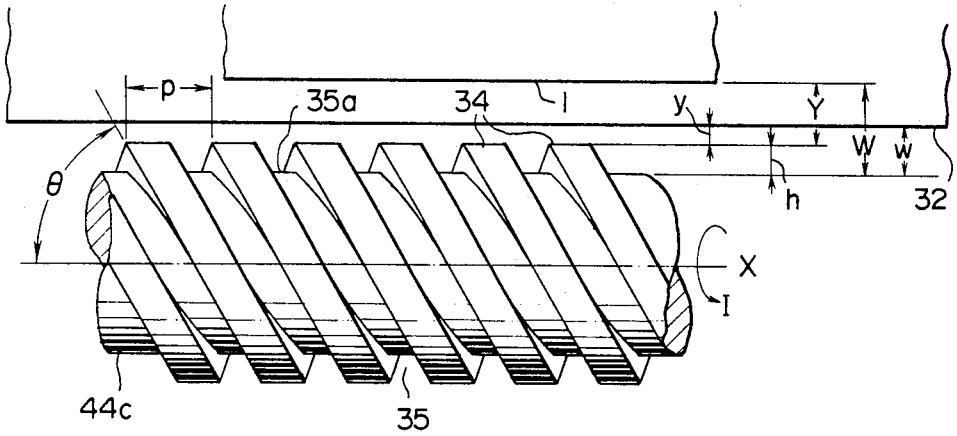
FIG. 13 is a partial perspective view of a further non-magnetic sleeve for use in the present invention.

Referring to FIG. 13, there is shown a further example of a non-magnetic sleeve 44*c* for use in the present invention. On the surface of the non-magnetic sleeve 44*c*, there are formed a plurality of spiral ridges 34 and grooves 35. The inclination of the spirals with respect to the axis of the non-magnetic sleeve is represented by $\theta$. The height of each ridge 34 is designated by h, and the pitch of the ridges 34, which is designated in FIG. 13 by the distance from one side wall of one groove to the corresponding side wall of the adjacent groove as shown in FIGS. 14(*a*) and 14(*b*), is p.

The height h, the pitch p, the inclination of the ridges 34 and grooves 35, $\theta$, and the rotation speed of the non-magnetic sleeve 44c can be determined depending upon the kind of developer employed. The cross section of the ridges 34 can be rectangular as shown in FIG. 14(*a*) or trapezoidal as shown in FIG. 14(*b*).

According to experiments conducted by the inventors of the present invention, in the case of the non-magnetic sleeve 44c, the best results were obtained when the height h was in the range of 0.5 mm to 2.5 mm, and the pitch p was approximately 2 mm, with the width of each ridge being about 1 mm and the width of each groove about 1 mm, and the inclination $\theta$ of the ridges and grooves was less than 90°. With respect to the inclination $\theta$, it is most preferable that inclination be in the range from about 70° to about 45°.

Figure 14A:
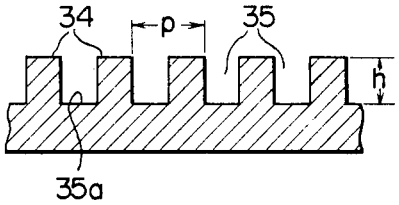
FIGS. 14(*a*) and 14(*b*) are sectional views of the ridges that can be formed on the surface of the non-magnetic sleeve of the type shown in FIG. 13.
Figure 14B:
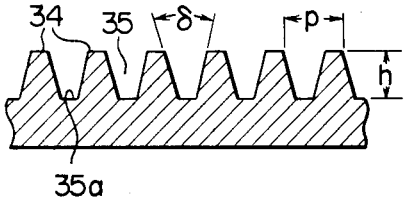

When the cross section of the ridges 34 is a trapzoid as shown in FIG. 14(*b*), it is preferable that the angle $\delta$ between the two side walls of each groove 35 be approximately 30°.

In the development apparatus shown in FIG. 13, the gap between the photoconductor 1 and the ridges 35 of the non-magnetic sleeve 44c is Y, which is set so as to be smaller than the gap between the photoconductor 1 and the conventional non-magnetic sleeve. Therefore, the counter electrode effect of the non-magnetic sleeve 44c is enhanced in comparison with the conventional non-magnetic sleeve, and, for the same reasons as have been explained with respect to the non-magnetic sleeve 44 in FIG. 8, the formation of a red fringe and a black fringe can be prevented (refer to FIGS. 11 and 12). Since the gap Y is set so as to be smaller than the gap between the photoconductor 1 and the conventional non-magnetic sleeve, the gap between the non-magnetic sleeve 44c and a doctor for regulating the amount of the developer on the non-magnetic sleeve 44c has to be reduced accordingly. However, since the non-magnetic sleeve 44c holds the developer not only on the ridges 34, but also in the grooves 35, a sufficient amount of the developer can be supplied to the development section, while enhancing the counter electrode effect.

In FIG. 13, W is the gap between the bottom surface 35a and the surface of the photoconductor 1, and W is the gap between the bottom surface 35a and a doctor 32. In the non-magnetic sleeve 44c, since the ridges 34 and grooves 35 are spirally made with an inclination of $\theta$ with respect to the axis of the non-magnetic sleeve 44c, the developer held on the non-magnetic sleeve is transported in the axial direction of the non-magnetic sleeve 44c during development, while coming into contact with the latent electrostatic images.

Although the edge effect is significantly prevented by the ridge 35 formed on the surface of the non-magnetic sleeve 44c, there is a tendency for a latent fringe portion to be formed around a red image area or a black image area in the photoconductor 1, and toner is apt to be attracted very weakly. It thus occurs that such a weak attraction of the toner to the latent fringe portion still formes a visible fringe in copy images when only the counter electrode effect is enhanced by only the formation of ridges on the surface of non-magnetic sleeve and when no other factor impedes such formation. However, in the non-magnetic sleeve 44c as shown in FIG. 13, the toner is moved in the axial direction of the non-magnetic sleeve 44c, while coming into contact with the latent electrostatic images, and the physical forces of such directional movement are sufficient to separate such weakly attracted fringe-portion toner from the photoconductor 1, whereby the edge effect is completely eliminated.

Figure 4:
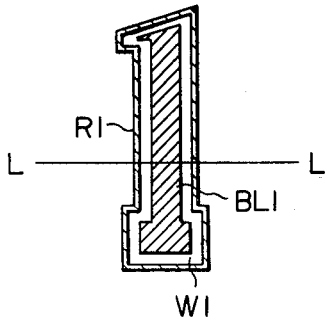
FIG. 4 is an illustration of a black copy image fringed with a thin red toner portion in explanation of the edge effect in two-color electrophotography.
Figure 5:
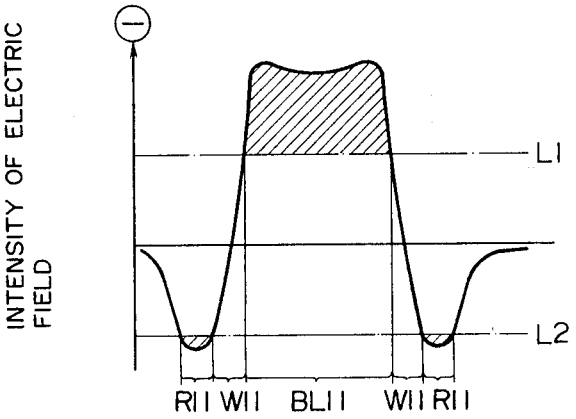
FIG. 5 is a diagram showing the distribution of the intensity of the electric field in the black copy image and thereabouts taken on Line L—L in FIG. 4.
Figure 6:
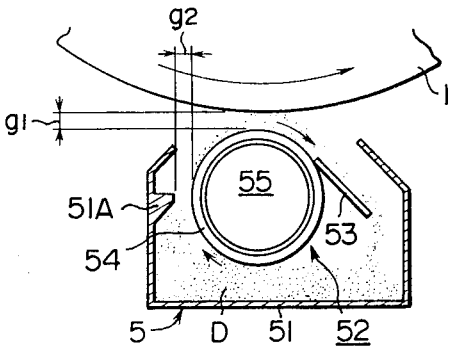
FIG. 6 is a diagrammatical view of one development apparatus for use in two-color electrophotography.
Figure 7A:
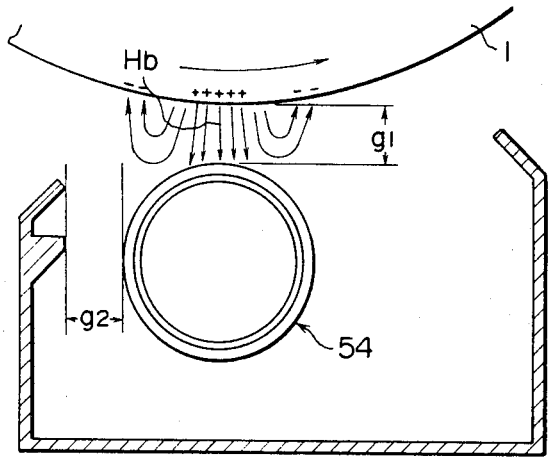
FIGS. 7(*a*) and 7(*b*) are diagrammatical views in explanation of the counter electrode effect of a non-magnetic sleeve for development.
Figure 7B:
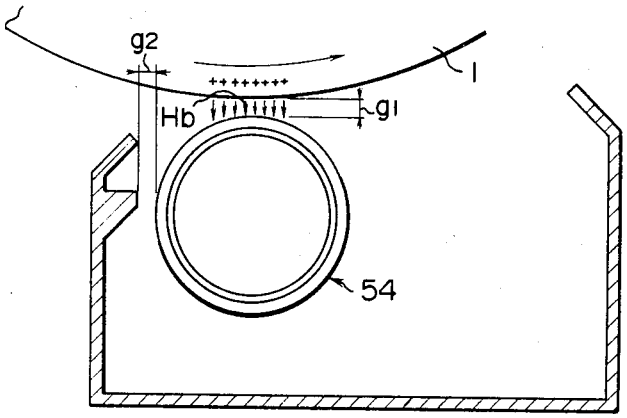

By using the non-magnetic sleeve 44c with the spiral ridges 34 formed on the surface thereof in the first development apparatus, the fringe portion R1 as illustrated in FIG. 4 can be eliminated.

This non-magnetic sleeve 44c can be used in the second development apparatus. When the non-magnetic sleeve 44c is also used in the second development apparatus, the following additional advantages can be obtained.

Referring back to FIG. 3, there is the risk that part of the toner of a first visible toner image developed on the photoconductor 1 in the first development apparatus will be scraped off during the second development by the second non-magnetic sleeve and transported into the second development apparatus.

In order to reduce such scraping of the toner, it is required that the rotation speed of the second non-magnetic sleeve be decreased, and the friction between the first developed image and the second non-magnetic sleeve be reduced. However, when the rotation speed of the second non-magnetic sleeve is decreased, the development performance of the second non-magnetic sleeve is decreased and, therefore, reducing the scraping of the toner of the first developed toner image by the second non-magnetic sleeve, and maintaining the development performance of the second non-magnetic sleeve, are conventionally contradictory to each other.

However, when the non-magnetic sleeve 44c as shown in FIG. 13 is employed in the second development apparatus as well, the developer on the non-magnetic sleeve 44c is moved not only in the circumferential direction of the non-magnetic sleeve, but also in the axial direction thereof. Therefore, even if the rotation speed of the non-magnetic sleeve 44c in the second development apparatus is decreased, so as to not harm the first developed toner image, the development performance remains adequate.

Experiments with respect to this matter conducted by the inventors of the present invention indicated the following results:

Conventionally, in order to prevent the decrease of development performance of the second non-magnetic sleeve in the second development apparatus, it is required that the ratio of the peripheral speed of the non-magnetic sleeve, vr, to the peripheral speed of the photoconductor, vp, be approximately 2.5 to 4.0, that is, $vr/vp \simeq 2.5$ to 4.0.

In contrast to this, when the non-magnetic sleeve 44c as shown in FIG. 13 is employed in the second development apparatus, the peripheral speed ratio can be decreased to 1.3 to 2.5, whereby the original development performance of the second non-magnetic sleeve can be maintained.

In the non-magnetic sleeve 44c as shown in FIG. 13, there are formed double spiral ridges 34. However, the number of the spiral ridges can be increased as desired.

When a non-magnetic sleeve 44c with continuous spiral ridges is employed in the development apparatus, the developer is transported along the non-magnetic sleeve in one direction. Therefore, some means for returning the developer in the opposite direction will be useful, if it is disposed within the casing of the development apparatus.

Other than the spiral ridges as shown in FIG. 13, ring-shaped parallel ridges which are formed on the outer peripheral surface of the non-magnetic sleeve, with an inclination less than 90°, preferably in the range of 45° to 70°, with respect to the axis of the non-magnetic sleeve, can be used.

When developer containing carrier particles with a comparatively small volume resistivity, which has been described previously, is employed in the second development apparatus including the non-magnetic sleeve 44*c*, the edge effect can be prevented more effectively.

Moreover, as will be readily apparent, great variation is possible in designing the precise form and orientation of the ridges and grooves in the present invention, particularly in regard to the above-described essentially spiral grooves and ridges which serve to add lateral, axial, movement to the carried developer. All such variations are contemplated as falling within the spirit and scope of the claims.

What is claimed is:

1. In a two-color electrophotographic copying apparatus for making two-color copies from two-color originals, by forming two latent electrostatic images with opposite polarities on a latent electrostatic image bearing member and developing the two latent electrostatic images successively by developers charged to opposite polarities which developers are respectively held in a first magnetic development apparatus and in a second magnetic development apparatus, the improvement wherein at least said first development apparatus comprises:

a magnetic roller comprising a non-magnetic sleeve with an inner magnet, which non-magnetic sleeve is rotatable relative to said inner magnet, and attracts developer to the peripheral surface thereof through the magnetic force of said magnet disposed inside said non-magnetic sleeve, and transports the attracted developer to a development section between the gap between said non-magnetic sleeve and the surface of said latent electrostatic image bearing member, said non-magnetic sleeve having ridges and grooves capable of retaining said developer therein on the surface thereof during development, the height of said ridges from the bottom of said grooves being in the range of 0.5 mm to 2.5 mm.

2. A two-color electrophotographic copying apparatus as claimed in claim 1, wherein said first development apparatus and said second development apparatus each comprise said magnetic roller.

3. A two-color electrophotographic copying apparatus as claimed in claim 1, wherein said ridges and grooves of said non-magnetic sleeve are formed, on the outer peripheral surface of said non-magnetic sleeve, in parallel with the axis of said non-magnetic sleeve.

4. A two-color electrophotographic copying apparatus as claimed in claim 1, wherein said ridges and grooves of said non-magnetic sleeve are formed, on the outer peripheral surface of said non-magnetic sleeve, in the shape of parallel rings with an inclination with respect to the axis of said non-magnetic sleeve.

5. A two-color electrophotographic copying apparatus as claimed in claim 1, wherein said ridges and grooves of said non-magnetic sleeve are spirally formed, on the outer peripheral surface of said non-magnetic sleeve, with an inclination with respect to the axis of said non-magnetic sleeve.

6. A two-color electrophotographic copying apparatus as claimed in claim 1, wherein the pitch of said ridges, which can be defined by the distance from the center of one ridge to the center of the adjacent ridge, is in the range of 1 mm to 20 mm and the width of said grooves is greater than 1/10 said pitch of said ridges.

7. A two-color electrophotographic copying apparatus as claimed in claim 4, wherein said inclination of said ridges and grooves with respect to the axis of said non-magnetic sleeve is less than 90°.

8. A two-color electrophotographic copying apparatus as claimed in claim 4, wherein said inclination of said ridges and grooves with respect to the axis of said non-magnetic sleeve is in the range of 70° to 45°.

9. A two-color electrophotographic copying apparatus as claimed in claim 5, wherein said inclination of said ridges and grooves is in the range of 70° to 45°, the width of each ridge is approximately 1 mm and the width of each groove is approximately 1 mm.

10. A two-color electrophotographic copying apparatus as claimed in claim 5, wherein said ridges and grooves are respectively composed of a plurality of spiral ridges and spiral grooves.

11. A two-color electrophotographic copying apparatus as claimed in claim 6, wherein said ridges and grooves of said non-magnetic sleeve are formed, on the outer peripheral surface of said non-magnetic sleeve, in parallel with the axis of said non-magnetic sleeve.

12. A two-color electrophotographic copying apparatus as claimed in claim 6, wherein said ridges and grooves of said non-magnetic sleeve are formed, on the outer peripheral surface of said non-magnetic sleeve, in the shape of parallel rings with an inclination with respect to the axis of said non-magnetic sleeve.

13. A two-color electrophotographic copying apparatus as claimed in claim 6, wherein said ridges and groove of said non-magnetic sleeve are spirally formed, on the outer peripheral surface of said non-magnetic sleeve, with an inclination with respect to the axis of said non-magnetic sleeve.

* * * * *

UNITED STATES PATENT AND TRADEMARK OFFICE

CERTIFICATE OF CORRECTION

PATENT NO. :4,389,113

DATED :June 21, 1983

INVENTOR(S) :Fuyuhiko Matsumoto et al.

It is certified that error appears in the above-identified patent and that said Letters Patent is hereby corrected as shown below:

On the title page, priority data should read

| | | |
|---|---|---|
| -- May 15, 1980 | Japan | 55-64633 |
| August 26, 1980 | Japan | 55-116426 --. |

Signed and Sealed this

*Twenty-second* Day of *November 1983*

[SEAL]

*Attest:*

GERALD J. MOSSINGHOFF

*Attesting Officer*

*Commissioner of Patents and Trademarks*